US006932917B2

(12) United States Patent
Golden et al.

(10) Patent No.: US 6,932,917 B2
(45) **Date of Patent: *Aug. 23, 2005**

(54) MAGNETORHEOLOGICAL FLUIDS

(75) Inventors: Mark A. Golden, Washington, MI (US); John C. Ulicny, Oxford, MI (US); Keith S. Snavely, Sterling Heights, MI (US); Anthony L. Smith, Troy, MI (US)

(73) Assignee: General Motors Corporation, Detroit, MI (US)

( * ) Notice: Subject to any disclaimer, the term of this patent is extended or adjusted under 35 U.S.C. 154(b) by 32 days.

This patent is subject to a terminal disclaimer.

(21) Appl. No.: 10/462,481

(22) Filed: Jun. 17, 2003

(65) Prior Publication Data

US 2004/0206928 A1 Oct. 21, 2004

Related U.S. Application Data

(63) Continuation-in-part of application No. 09/923,302, filed on Aug. 6, 2001, now abandoned.

(51) Int. Cl.[7] ..... H01F 1/44

(52) U.S. Cl. ..... 252/62.52

(58) Field of Search ..... 242/62.52

(56) References Cited

U.S. PATENT DOCUMENTS

| | | | | |
|---|---|---|---|---|
| 4,957,644 | A | 9/1990 | Price et al. | 252/62.52 |
| 4,992,190 | A | 2/1991 | Shtarkman | 252/62.52 |
| 5,354,488 | A | 10/1994 | Shtarkman et al. | 252/62.56 |
| 5,382,373 | A | 1/1995 | Carlson et al. | 252/62.55 |
| 6,547,983 | B2 * | 4/2003 | Iyengar | 252/62.52 |
| 6,599,439 | B2 * | 7/2003 | Iyengar et al. | 252/62.52 |
| 2003/0034475 | A1 | 2/2003 | Ulicny et al. | |
| 2003/0042461 | A1 | 3/2003 | Ulicny et al. | |

* cited by examiner

*Primary Examiner*—C. Melissa Koslow
(74) *Attorney, Agent, or Firm*—Cary W. Brooks

(57) ABSTRACT

One embodiment of the invention includes an MR fluid of improved durability. The MR fluid is particularly useful in devices that subject the fluid to substantial centrifugal forces, such as large fan clutches. A particular embodiment includes a magnetorheological fluid including 10 to 14 wt % of a hydrocarbon-based liquid, 86 to 90 wt % of bimodal magnetizable particles, and 0.05 to 0.5 wt % fumed silica.

13 Claims, 3 Drawing Sheets

MAGNETORHEOLOGICAL FLUIDS

This is a continuation-in-part and claims benefit of U.S. application Ser. No. 09/923,302 filed Aug. 6, 2001 now abandoned.

TECHNICAL FIELD

This invention pertains to fluid materials which exhibit substantial increases in flow resistance when exposed to a suitable magnetic field. Such fluids are sometimes called magnetorheological fluids because of the dramatic effect of the magnetic field on the rheological properties of the fluid.

BACKGROUND OF THE INVENTION

Magnetorheological (MR) fluids are substances that exhibit an ability to change their flow characteristics by several orders of magnitude and on the order of milliseconds under the influence of an applied magnetic field. An analogous class of fluids are the electrorheological (ER) fluids which exhibit a like ability to change their flow or rheological characteristics under the influence of an applied electric field. In both instances, these induced rheological changes are completely reversible. The utility of these materials is that suitably configured electromechanical actuators which use magnetorheological or electrorheological fluids can act as a rapidly responding active interface between computer-based sensing or controls and a desired mechanical output. With respect to automotive applications, such materials are seen as a useful working media in shock absorbers, for controllable suspension systems, vibration dampers in controllable powertrain and engine mounts and in numerous electronically controlled force/torque transfer (clutch) devices.

MR fluids are noncolloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. At the present state of development, MR fluids appear to offer significant advantages over ER fluids, particularly for automotive applications, because the MR fluids are less sensitive to common contaminants found in such environments, and they display greater differences in rheological properties in the presence of a modest applied field.

Since MR fluids contain noncolloidal solid particles which are often seven to eight times more dense than the liquid phase in which they are suspended, suitable dispersions of the particles in the fluid phase must be prepared so that the particles do not settle appreciably upon standing nor do they irreversibly coagulate to form aggregates. Examples of suitable magnetorheological fluids are illustrated, for example, in U.S. Pat. Nos. 4,957,644 issued Sep. 18, 1990, entitled "Magnetically Controllable Couplings Containing Ferrofluids"; 4,992,190 issued Feb. 12, 1991, entitled "Fluid Responsive to a Magnetic Field"; 5,167,850 issued Dec. 1, 1992, entitled "Fluid Responsive to a Magnetic Field"; 5,354,488 issued Oct. 11, 1994, entitled "Fluid Responsive to a Magnetic Field"; and 5,382,373 issued Jan. 17, 1995, entitled "Magnetorheological Particles Based on Alloy Particles".

As suggested in the above patents and elsewhere, a typical MR fluid in the absence of a magnetic field has a readily measurable viscosity that is a function of its vehicle and particle composition, particle size, the particle loading, temperature and the like. However, in the presence of an applied magnetic field, the suspended particles appear to align or cluster and the fluid drastically thickens or gels. Its effective viscosity then is very high and a larger force, termed a yield stress, is required to promote flow in the fluid.

SUMMARY OF THE INVENTION

Certain aspects of prior art MR fluids such as those described in the above-identified patents will illustrate the benefits and advantages of the subject invention. A first observation in characterizing MR fluids is that for any applied magnetic field (or equivalently for any given magnetic flux density), the magnetically induced yield stress increases with the solid particle volume fraction. This is the most obvious and most widely employed compositional variable used to increase the MR effect. This is illustrated in FIG. 1, which is a graph recording the yield stress in pounds per square inch of suspensions of pure iron microspheres dispersed in a polyalphaolefin liquid vehicle at increasing volume fractions. The strength of the magnetic field applied is 1.0 Tesla. It is seen that the yield stress increases gradually from about 5 psi at a volume fraction of iron microspheres of 0.1 to a value of about 18 psi at a volume fraction of 0.55. In order to double the yield stress from 5 psi at a volume fraction of 0.1, it is necessary to increase the volume fraction of microspheres to about 0.45. However, as the volume fraction of solid increases in the on-state, the viscosity in the off-state increases dramatically and much more rapidly as well. This is illustrated in FIG. 2. FIG. 2 is a semilog plot of viscosity in centipoise versus the volume fraction of the same suspension of iron microspheres. It is seen that a small increase in the volume fraction of microspheres results in a dramatic increase in the viscosity of the fluid in the off-state. Thus, while the yield stress may be doubled by increasing the volume fraction from 0.1 to 0.45, the viscosity increases from about 15 centipoise to over 200 centipoise. This means that the turn-up ratio (shear stress "on" divided by shear stress "off") at 1.0 Tesla actually decreases by more than a factor of 10.

In terms of basic rheological properties, the turn-up ratio is defined as the ratio of the shear stress at a given flux density to the shear stress at zero flux density. At appreciable flux densities, for example of the order of 1.0 Tesla, the shear stress "on" is given by the yield stress, while in the off state, the shear stress is essentially the viscosity times the shear rate. With reference to FIG. 1, for a volume fraction of 0.55, at 1.0 Tesla the yield stress is 18 psi. This fluid has a viscosity of 2000 cP, which, if subjected to a shear rate of 1000 reciprocal seconds (as in a rheometer), gives an off-state shear stress of approximately 0.3 psi (where 1 cP=$1.45\times10^{-7}$ lbf s/m$^2$). Thus, the turn-up ratio at 1.0 Tesla is (18/0.3), or 60. However, in a device in which the shear rate is higher, e.g., 30,000 seconds$^{-1}$, the turn-up ratio is then only 2.0.

The observation that the on and off-states of MR fluids have been coupled in the sense that any attempt to maximize the on-state yield stress by increasing the solid volume fraction will carry a great penalty in turn-up ratio because the viscosity in the off-state will increase at the same time, as illustrated by the above example. This has been generally recognized in the prior art and has been stated explicitly in, for example, U.S. Pat. No. 5,382,373 at column 3. For a given type of magnetizable solid, experience has identified no other variable such as fluid type, solid surface treatment, anti-settling agent or the like which has anything like the effect of volume fraction on the yield stress of the MR fluid. Therefore, it is necessary to find a means of decoupling the on-state yield stress and the off-state viscosity and their mutual dependence on solid volume fraction.

In accordance with the subject invention, this decoupling is accomplished by using a solid with a "bimodal" distribution of particle sizes instead of a monomodal distribution to minimize the viscosity at a constant volume fraction. By "bimodal" is meant that the population of solid ferromagnetic particles employed in the fluid possess two distinct maxima in their size or diameter and that the maxima differ as follows.

Preferably, the particles are spherical or generally spherical such as are produced by a decomposition of iron pentacarbonyl or atomization of molten metals or precursors of molten metals that may be reduced to the metals in the form of spherical metal particles. In accordance with the practice of the invention, such two different size populations of particles are selected—a small diameter size and a large diameter size. The large diameter particle group will have a mean diameter size with a standard deviation no greater than about two-thirds of said mean size. Likewise, the smaller particle group will have a small mean diameter size with a standard deviation no greater than about two-thirds of that mean diameter value. Preferably, the small particles are at least one micron in diameter so that they are suspended and function as magnetorheological particles. The practical upper limit on the size is about 100 microns since particles of greater size usually are not spherical in configuration but tend to be agglomerations of other shapes. However, for the practice of the invention the mean diameter or most common size of the large particle group preferably is five to ten times the mean diameter or most common particle size in the small particle group. The weight ratio of the two groups shall be within 0.1 to 0.9. The composition of the large and small particle groups may be the same or different. Carbonyl iron particles are inexpensive. They typically have a spherical configuration and work well for both the small and large particle groups.

It has been found that the off-state viscosity of a given MR fluid formulation with a constant volume fraction of MR particles depends on the fraction of the small particles in the bimodal distribution. However, the magnetic characteristics (such as permeability) of the MR fluids do not depend on the particle size distribution, only on the volume fraction. Accordingly, it is possible to obtain a desired yield stress for an MR fluid based on the volume fraction of bimodal particle population, but the off-state viscosity can be reduced by employing a suitable fraction of the small particles.

For a wide range of MR fluid compositions, the turn-up ratio can be managed by selecting the proportions and relative sizes of the bimodal particle size materials used in the fluid. These properties are independent of the composition of the liquid or vehicle phase so long as the fluid is truly an MR fluid, that is, the solids are noncolloidal in nature and are simply suspended in the vehicle. The viscosity contribution and the yield stress contribution of the particles can be controlled within a wide range by controlling the respective fractions of the small particles and the large particles in the bimodal size distribution families. For example, in the case of the pure iron microspheres a significant improvement in turn-up ratio is realized with a bimodal formulation of 75% by volume large particles-25% small particles where the arithmetic mean diameter of the large particles is seven to eight times as large as the mean diameter of the small particles.

One embodiment of the invention includes an MR fluid of improved durability. The MR fluid is particularly useful in devices that subject the fluid to substantial centrifugal forces, such as large fan clutches. A particular embodiment includes a magnetorheological fluid including 10 to 14 wt % of a hydrocarbon-based liquid, 86 to 90 wt % of bimodal magnetizable particles, and 0.05 to 0.5 wt % fumed silica.

In another embodiment of the invention, the bimodal magnetizable particles consist essentially of a first group of particles having a first range of diameter sizes with a first mean diameter having a standard deviation no greater than about ⅔ of the value of the mean diameter and a second group of particles with a second range of diameter sizes and a second mean diameter having a standard deviation no greater than about ⅔ of the second mean diameter, such that the majority portion of the particles falls within the range of one to 100 microns, and the weight range of the first group to the second group ranges from about 0.1 to 0.9, and the ratio of the first mean diameter to the second mean diameter is 5 to 10.

In another embodiment of the invention, the particles include at least one of iron, nickel and cobalt.

In another embodiment of the invention, the particles include carbonyl iron particles having a mean diameter in the range of one to 10 microns.

In another embodiment of the invention, the first and second groups of particles are of the same composition.

In another embodiment of the invention, the hydrocarbon-based liquid includes a polyalphaolefin.

In another embodiment of the invention, the hydrocarbon-based liquid includes a homopolymer of 1-decene which is hydronated.

Another embodiment of the invention includes a magnetorheological fluid including 10 to 14 wt % of a polyalphaolefin liquid, 86 to 90 wt % of magnetizable particles, and 0.05 to 0.5 wt % fumed silica. The magnetizable particles include at least one of iron, nickel and cobalt-based materials. The particles may include carbonyl iron consisting essentially of a first group of particles having a first range of diameter sizes with a first mean diameter having a standard deviation no greater than about ⅔ of the value of the mean diameter and a second group of particles with a second range of diameter sizes and a second mean diameter having a standard deviation no greater than about ⅔ of the second mean diameter, such that the majority of all particle sizes falls within the range of one to 100 microns and the weight ratio of the first group to the second group is in the range of 0.1 to 0.9, and the ratio of the first mean diameter to the second mean diameter is 5 to 10.

DESCRIPTION OF THE PREFERRED EMBODIMENT

Figure 1:
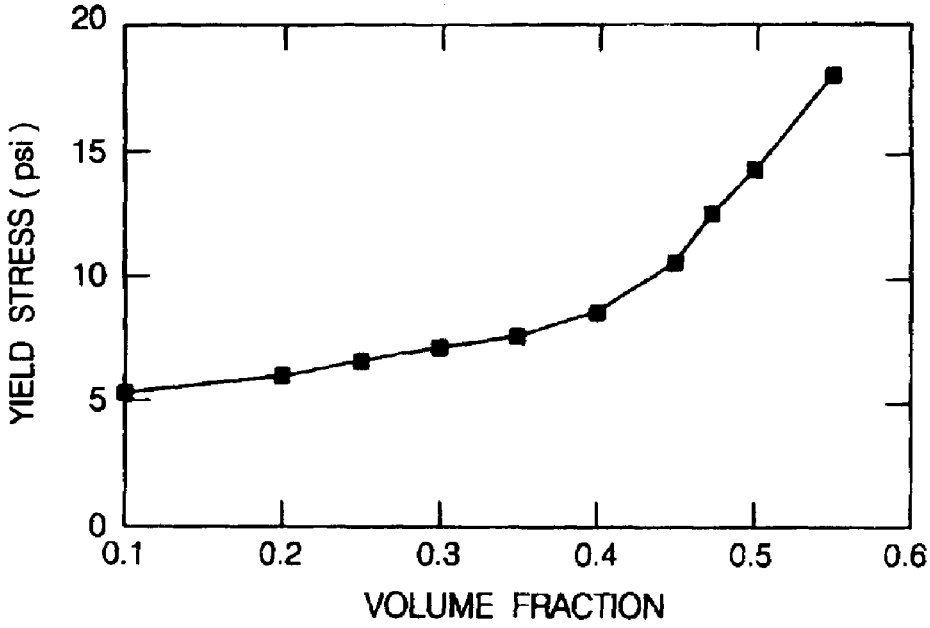
PRIOR ART FIG. 1
FIG. 1 is a graph of yield stress (psi) vs. volume fraction of monomodal size distribution carbonyl iron particles and an MR fluid mixture with a magnetic flux density of one tesla.

The invention is an improvement over the magnetorheological fluids (MRF) disclosed in Foister U.S. Pat. No.

5,667,715 issued Sep. 16, 1997, the disclosure of which is hereby incorporated by reference. The invention is an MRF consisting of a synthetic hydrocarbon base oil, a particular bimodal distribution of particles in the micron-size range and a fumed silica suspending agent. When this fluid is exposed to a magnetic field, the yield stress of the MRF increases by several orders of magnitude. This increase in yield stress can be used to control the fluid coupling between two rotating members such as in a clutch. This change in yield stress is rapid (takes place in milliseconds) and reversible. Since the magnetic field can be rapidly controlled by the application of a current to the field coil, the yield stress of the fluid, and thus the clutch torque, can be changed just as rapidly.

This MRF is unique in several ways. First, it uses a very low molecular weight ranging from about 280 to about 300 (MW<300) synthetic hydrocarbon base fluid which allows the devices in which it is used to operate satisfactorily at low ambient temperatures (down to −40° C. in an automobile, for example). Second, the MRF is made with a particular combination of iron particles of different sizes using a particle ratio of sizes. This bimodal distribution provides an optimum combination of on-state yield stress and low viscosity. Third, the inherent problem of particle settling is overcome by the use of fumed silica. Using fumed silica, the MRF forms a gel-like structure which retards separation of the base fluid and the iron particles both due to gravity in a container and to gravitation acceleration in a clutch device. This method of overcoming the particle settling problem is opposed to that used in other MRFs which apparently count on redispersal of the particles after the inevitable settling has occurred. Furthermore, fumed silica need be used only at very low concentrations to achieve the desired effects.

The MRF described here is designed to work in the following environment: temperature range=−40° C. to +300° C. (internal device temperature); magnetic flux density=0 to 1.6 Tesla; gravitation field=1 to 1300 g. Preferred example: A typical working environment (e.g., an automotive fan drive) consists of an ambient temperature of 65° C. (150° F.), magnetic flux density of 0.6 Tesla and gravitational field of 500 g. The MRF must withstand not only the ambient temperature but also the transient temperatures generated during the operation of a clutch which, internally, can reach the range indicated. It is important that the MRF have a low viscosity at the low end of the indicated temperature range so that a device such as a fan drive will operate at minimal speed when engine cooling is not required. The fluid must provide a suitable range of yield stress for the device so as to provide sufficient torque to drive a cooling fan, for example. The gravitational field exerted on the fluid is a consequence of the rotary motion of the device, and it tends to separate the iron particles from the suspension. The suspension must be robust enough to withstand these artificial gravitation forces without separation.

In general the practice of the invention is widely applicable to MR fluid components. For example, the solids suitable for use in the fluids are magnetizable, low coercivity (i.e., little or no residual magnetism when the magnetic field is removed), finely divided particles of iron, nickel, cobalt, iron-nickel alloys, iron-cobalt alloys, iron-silicon alloys and the like which are spherical or nearly spherical in shape and have a diameter in the range of about 1 to 100 microns. Since the particles are employed in noncolloidal suspensions, it is preferred that the particles be at the small end of the suitable range, preferably in the range of 1 to 10 microns in nominal diameter or particle size. The particles used in MR fluids are larger and compositionally different than the particles that are used in "ferrofluids" which are colloidal suspensions of, for example, very fine particles of iron oxide having diameters in the 10 to 100 nanometers range. Ferrofluids operate by a different mechanism from MR fluids. MR fluids are suspensions of solid particles which tend to be aligned or clustered in a magnetic field and drastically increase the effective viscosity or flowability of the fluid.

This invention is also applicable to MR fluids that utilize any suitable liquid vehicle. The liquid or fluid carrier phase may be any material which can be used to suspend the particles but does not otherwise react with the MR particles. Such fluids include but are not limited to water, hydrocarbon oils, other mineral oils, esters of fatty acids, other organic liquids, polydimethylsiloxanes and the like. As will be illustrated below, particularly suitable and inexpensive fluids are relatively low molecular weight hydrocarbon polymer liquids as well as suitable esters of fatty acids that are liquid at the operating temperature of the intended MR device and have suitable viscosities for the off condition as well as for suspension of the MR particles.

A suitable vehicle (liquid phase) for the MRF is a hydrogenated polyalphaolefin (PAO) base fluid, designated SHF21, manufactured by Mobil Chemical Company. The material is a homopolymer of 1-decene which is hydrogenated. It is a paraffin-type hydrocarbon and has a specific gravity of 0.82 at 15.6° C. It is a colorless, odorless liquid with a boiling point ranging from 375° C. to 505° C., and a pour point of −57° C. The liquid phase may be present in 10 to 14 wt % of the MRF.

A suitable magnetizable solid phase includes CM carbonyl iron powder and HS carbonyl iron powder, both manufactured by BASF Corporation. The carbonyl iron powders are gray, finely divided powders made from pure metallic iron. The carbonyl iron powders are produced by thermal decomposition of iron pentacarbonyl, a liquid which has been highly purified by distillation. The spherical particles include carbon, nitrogen and oxygen. These elements give the particles a core/shell structure with high mechanical hardness. CM carbonyl iron powder includes more than 99.5 wt % iron, less than 0.05 wt % carbon, about 0.2 wt % oxygen, and less than 0.01 wt % nitrogen, which a particle size distribution of less than 10% at 4.0 $\mu$m, less than 50% at 9.0 $\mu$m, and less than 90% at 22.0 $\mu$m, with true density>7.8 g/cm$^3$. The HS carbonyl iron powder includes minimum 97.3 wt % iron, maximum 1.0 wt % carbon, maximum 0.5 wt % oxygen, maximum 1.0 wt % nitrogen, with a particle size distribution of less than 10% at 1.5 $\mu$m, less than 50% at 2.5 $\mu$m, and less than 90% at 3.5 $\mu$m. As indicated, the weight ratio of CM to HS carbonyl powder may range from 3:1 to 1:1 but preferably is about 1:1. The total solid phase (carbonyl iron) may be present in 86 to 90 wt % of the MRF.

In the preferred embodiment of this invention, fumed silica is added in about 0.05 to 0.5, preferably 0.5 to 0. 1, and most preferably 0.05 to 0.06 weight percent of the MRF. The fumed silica is a high purity silica made from high temperature hydrolysis having a surface area in the range of 100 to 300 square meters per gram.

EXAMPLE 1

A preferred embodiment of the present invention includes:

11.2 wt % SFH21 (alpha olefin) (Mobil Chemical)
44.4 wt % CM carbonyl iron powder (BASF Corporation)
44.4 wt % HS carbonyl iron powder (BASF Corporation)
0.06 wt % fumed silica (Cabot Corporation)

The MR fluid of Example 1 provided improved performance in a clutch having a diameter of about 100 mm.

Figure 3:
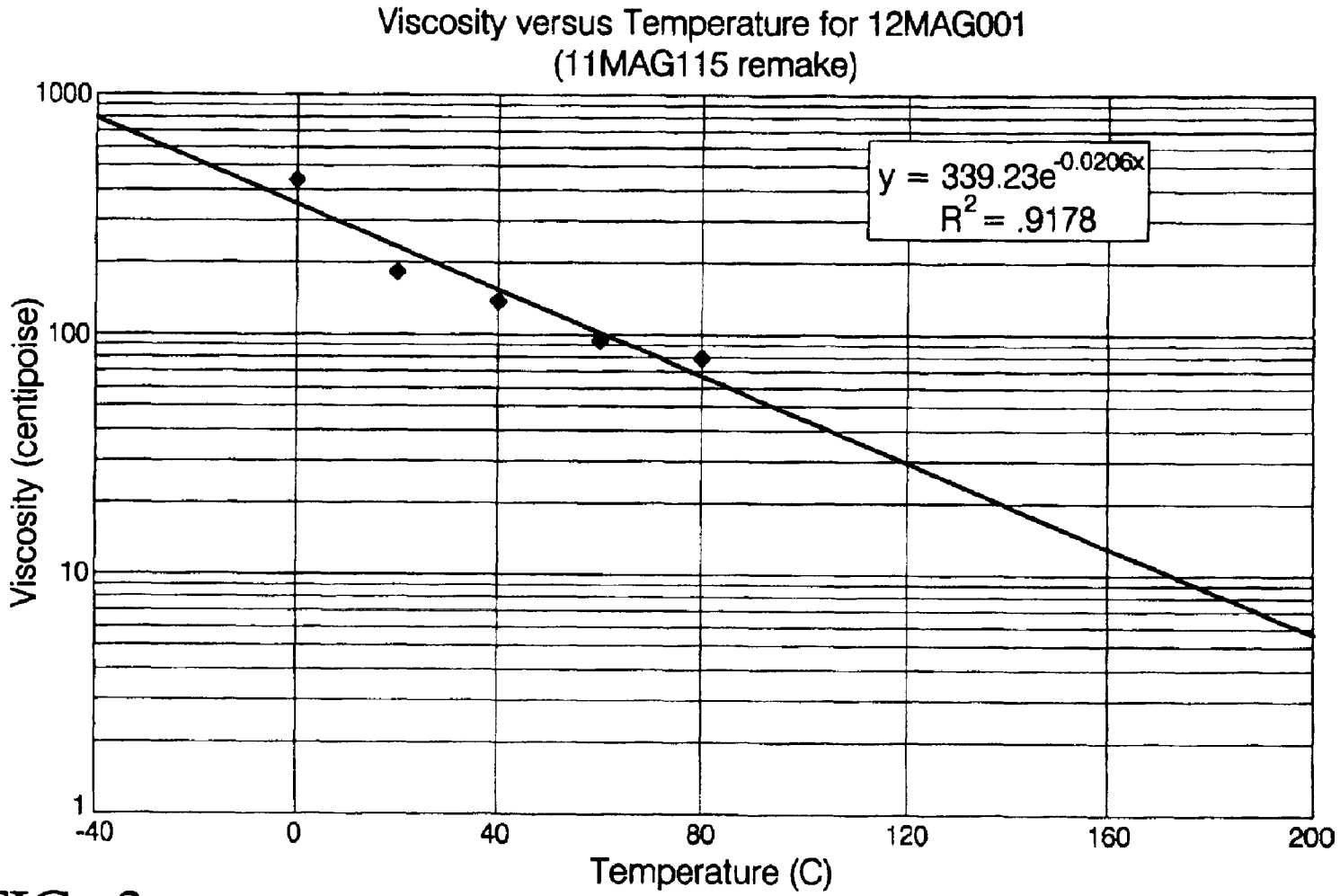
FIG. 3 is a plot of viscosity vs. temperature of an MR fluid according to the present invention.

FIG. 3 is a graph of the viscosity of the MRF of Example 1 versus temperature. As will be appreciated, the MRF of Example 1 has an acceptable viscosity at −40° C. for a working fluid in automotive applications.

Figure 2:
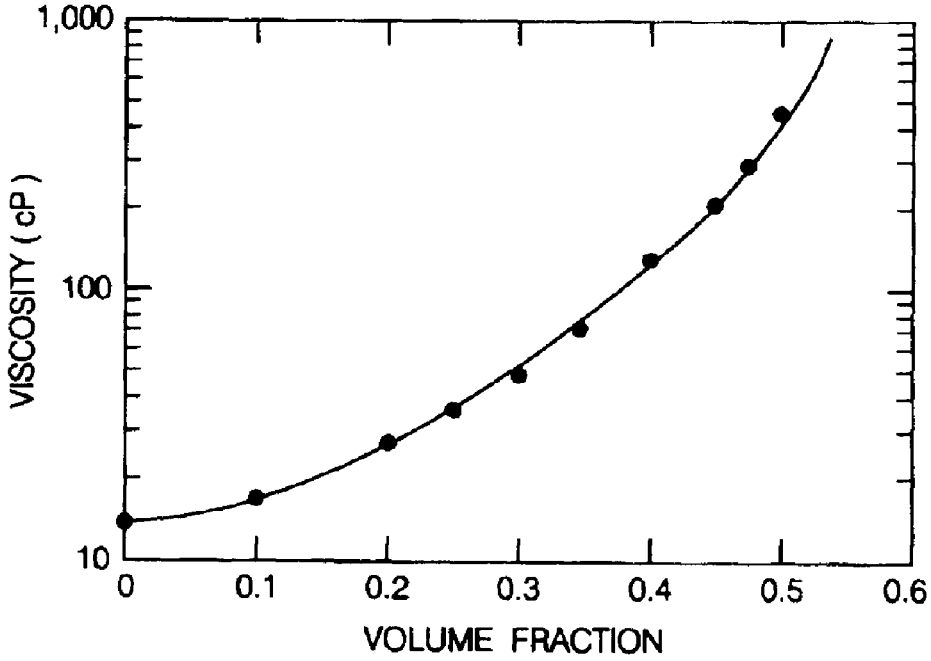
PRIOR ART FIG. 2
FIG. 2 is a graph of the viscosity vs. volume fraction of carbonyl iron microspheres for the same family of MR fluids whose yield stress is depicted at FIG. 1.
Figure 4:
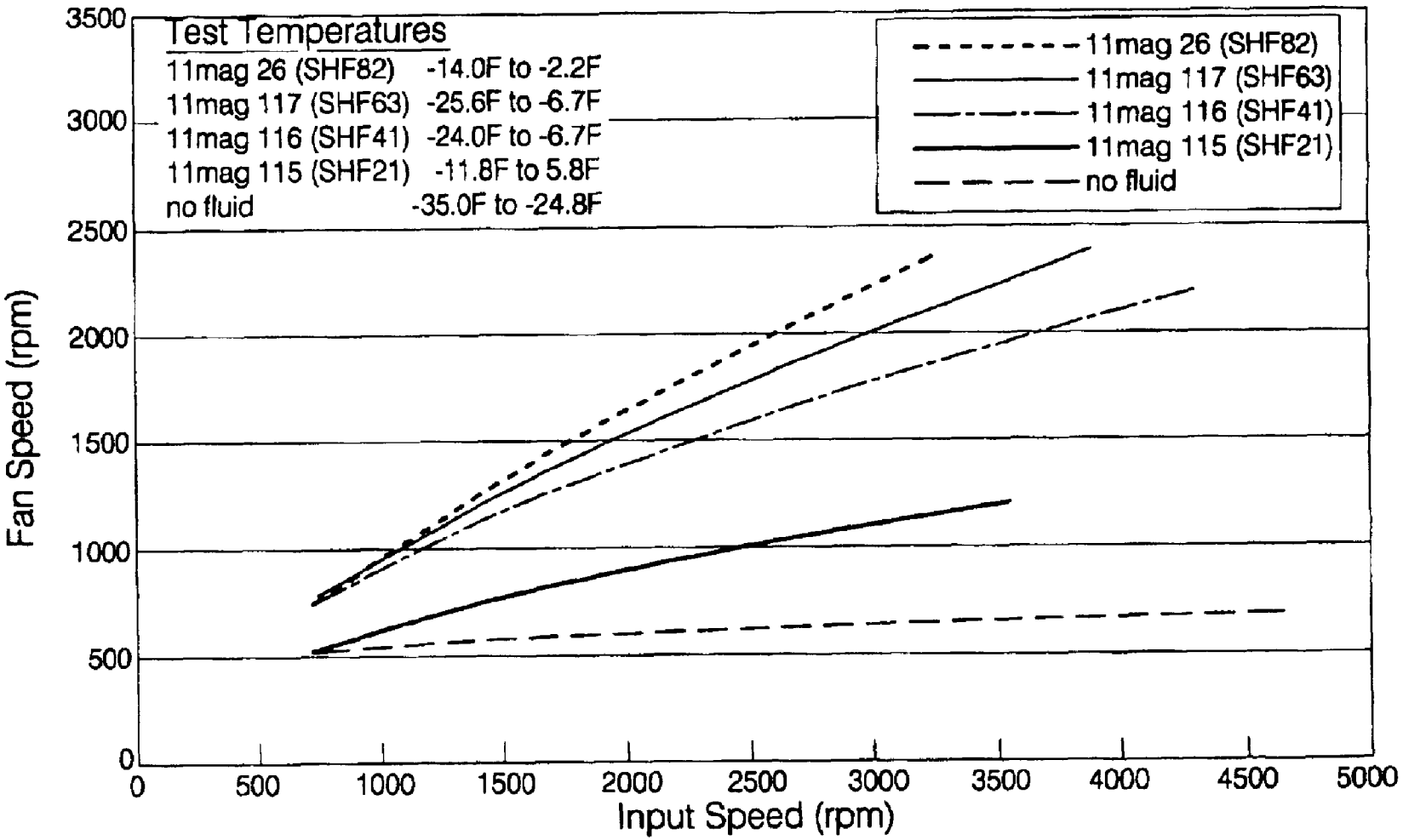
FIG. 4 is a graph of the cold cell smooth rotor drag speeds of a variety of MR fluids including an MR fluid according to the present invention plotting fan speed vs. input speed.

FIG. 4 is a graph of smooth rotor drag speed for various formulations of MRFs including that in Example 1 (indicated by line 11 MAG 115). As will be appreciated from FIG. 2, the MRF of Example 1 produced much lower drag in the nonengaged (magnetic field off) state than the other fluid, and thus had less lost work associated with its work.

DURABILITY TESTING

The MR fluid described in Example 1 above was subjected to a durability test. The durability test was conducted using a MRF fan clutch. The durability test procedure subjected the clutch to prescribed input speeds and desired fan speed profiles. An electric motor drove the input of the fan clutch along the input speed profile. The desired fan speed profile was the reference input to a feedforward +P1 controller that regulated the current applied to the clutch. The current applied varied the yield stress of the MR fluid, which allowed for control of the fan speed. A constant test box temperature of 150° F. was used to simulate the underhood temperatures of an automobile typically experienced by a fan clutch. Current was passed through the fan clutch in a manner to change the current from low to high and back to low again. The corresponding fan speed was measured. A maximum input current was set at 5 amperes. The amount of current needed to achieve the desired, particularly the maximum, fan speed was measured. An increase in current indicates that the controller is commanding higher current levels to compensate for the degradation in the MR fluid. If the current command reaches 5 amperes, the controller output is saturated and the controller can no longer compensate for the degradation in the MR fluid properties. A 20 minute durability cycle was repeated 250 times for a total of 500 hours.

PERFORMANCE TESTING

The criterion for a fluid to pass the durability test is the performance test. The performance test consists of commanding a series of fan speeds at a fixed input speed and measuring the actual cooling fan speed and input current necessary to achieve the required fan speeds. The primary requirement is that all of the commanded fan speeds are achieved, and in particular the highest fan speed, with no more than 10 percent decrease in fan speed. The performance tests are routinely performed before the start of the durability test (at zero hours), approximately halfway through the durability test (about 250 hours) and at the end of the durability test (after 500 hours). During the performance test, the current levels required increased with time as expected but the maximum current required was less than 4 amperes in all cases. The fan speeds obtained were also all within the 10% criterion established for this test for all three performance tests, and as such the MR fluid of Example 1 passed the durability test.

It may be desirable to add other additives for larger clutches such as a molybdenum additive. Preferably, a molybdenum-amine compiled additive is included in the MRF to provide both reduction in drag over time (friction reduction) and to reduce the tendency of the iron particles to oxides. A preferred molybdenum-amine complex has the formula:

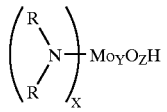

wherein R may be an alkyl group and x, y, and z are 1, 2 or 3. A suitable molybdenum-amine complex is available from Asahi-Denko under the tradename Sakura-Lube 700.

The molybdenum-amine complex may be present in about 0.5% to 5% of the total liquid mass.

It may also be desirable to include an additive package including a lithium stearate thickener and zinc dialkyl dithiophosphate (ZDDP) friction modifier. The lithium stearate and ZDDP both provide for an apparent reduction in drag over time (friction reduction) and make it possible for this MRF to be used in a larger-sized fan clutch. The additive package allows the MRF to maintain its yield stress (torque capacity) over a much longer period of service. The ZDDP may also reduce the oxidation of the iron particles in the MRF, thereby improving the long-term durability of the fluid. Preferably, the lithium stearate is lithium 12-hydroxy stearate present in about 0.3 to 0.5 wt % of the fluid. Preferably, the ZDDP is present in about 0.03 to 0.05 wt % of the fluid. Alternatively, the stearate and the ZDDP together are used in the concentration range of 0.5% to 5% of the total mass of the liquid.

It may also be desirable to include a second additive package paraffin oil together with 2,4,6-bis(1,1-dimethyl ethyl)-phenol, Di-t-butyl trisulfide. The phenol is believed to reduce the oxidation of the iron particles in the MRF and the sulfide is believed to extend the durability of the MRF. The second additive package may be used in the concentration range between 0.5% and 5% of the total mass of the liquid.

What is claimed is:

1. A magnetorheological fluid comprising:

10 to 14 weight percent of a hydrocarbon-based liquid;

86 to 90 weight percent of bimodal magnetizable particles; and 0.05 to 0.5 weight percent fumed silica.

2. A magnetorheological fluid as set forth in claim 1 wherein the bimodal magnetizable particles consist essentially of:

a first group of particles having a first range of diameter sizes with a first mean diameter having a standard deviation no greater than about two-thirds of the value of said mean diameter and a second group of particles with a second range of diameter sizes and a second mean diameter having a standard deviation no greater then about two-thirds of said second mean diameter, such that the major portion of all particle sizes fall within the range of one to 100 microns and the weight ratio of said first group to said second group is in the range of 0.1 to 0.9, and the ratio of said first mean diameter to said second mean diameter is five to ten.

3. A fluid as recited in claim 1 in which said bimodal magnetizable particles comprise at least one of iron, nickel and cobalt.

4. A fluid as recited in claim 1 in which said bimodal magnetizable particles comprise carbonyl iron particles having a mean diameter in the range of one to ten microns.

5. A fluid as set forth in claim 2 wherein the first and second groups of particles are of the same composition.

6. A fluid as set forth in claim 1 wherein the hydrocarbon-based liquid comprises a polyalphaolefin.

7. A fluid as set forth in claim 1 wherein the hydrocarbon-based liquid comprises a homopolymer of 1-decene which is hydrogenated.

8. A magnetorheological fluid comprising:

10 to 14 weight percent of a liquid phase comprising a polyalphaolefin;

86 to 90 weight percent of magnetizable particles; and 0.05 to 0.5 weight percent fumed silica.

9. A fluid as set forth in claim 8 wherein the magnetizable particles comprise one or more selected from the group consisting of iron-, nickel- and cobalt-based materials.

10. A fluid as set forth in claim 8 wherein the particles comprise carbonyl iron and consist essentially of:

a first group of particles having a first range of diameter sizes with a first mean diameter having a standard deviation no greater than about two-thirds of the value of said mean diameter and a second group of particles with a second range of diameter sizes and a second mean diameter having a standard deviation no greater than about two-thirds of said second mean diameter, such that the major portion of all particle sizes fall within the range of one to 100 microns and the weight ratio of said first group to said second group is in the range of 0.1 to 0.9, and the ratio of said first mean diameter to said second mean diameter is five to ten.

11. A fluid as set forth in claim 8 wherein the molecular weight of the polyalphaolefin ranges from about 280 to less than 300.

12. A magnetorheological fluid comprising a liquid phase including a polyalphaolefin, magnetizable particles and 0.05 to 0.5 weight percent fumed silica.

13. A fluid as set forth in claim 12 wherein the magnetizable particles are bimodal.

* * * * *